US005640174A

United States Patent [19]

Kamei et al.

[11] Patent Number: 5,640,174

[45] Date of Patent: Jun. 17, 1997

[54] METHOD OF DRIVING AN ACTIVE MATRIX LIQUID CRYSTAL DISPLAY PANEL WITH ASYMMETRIC SIGNALS

[75] Inventors: Tatsuo Kamei; Kenichi Iwamoto; Yoshio Owaki; Jun-ichi Ohwada, all of Mobara, Japan

[73] Assignees: Hitachi, Ltd., Tokyo; Hitachi Device Engineering Co., Ltd., Mobara, both of Japan

[21] Appl. No.: 574,573

[22] Filed: Dec. 14, 1995

Related U.S. Application Data

[63] Continuation of Ser. No. 432,864, May 2, 1995, abandoned, which is a continuation of Ser. No. 281,575, Jul. 28, 1994, abandoned.

[30] Foreign Application Priority Data

Jul. 29, 1993 [JP] Japan ..... 5-207268

[51] Int. Cl.[6] ..... G09G 3/36

[52] U.S. Cl. ..... 345/89; 345/96; 345/209

[58] Field of Search ..... 345/87, 89, 94, 345/95, 208, 209, 210, 96

[56] References Cited

U.S. PATENT DOCUMENTS 4,789,223 12/1988 Kashara et al. .
5,250,937 10/1993 Kikuo et al. ..... 345/89

FOREIGN PATENT DOCUMENTS 532191 3/1993 European Pat. Off. ..... 345/89
63-19628 1/1988 Japan .
3-177890 8/1991 Japan .
4-70611 11/1992 Japan .

OTHER PUBLICATIONS

*Hitachi LED Driver Data Book*, Hitachi, Ltd., Mar. 1990, pp. 650–665 (Japanese edition) and pp. 910–929 (English edition).

*Nikkei Electronics*, Nikkei McGraw–Hill, Sep. 10, 1994, pp. 211–240 (in Japanese).

*Primary Examiner*—Raymond J. Bayerl
*Assistant Examiner*—Matthew Luu
*Attorney, Agent, or Firm*—Antonelli, Terry, Stout & Kraus, LLP

[57] ABSTRACT

A method for driving a liquid crystal display device including a TFT liquid crystal display panel. The TFT liquid crystal display panel includes a plurality of pixel electrodes, a common electrode opposing the pixel electrodes, and a liquid crystal layer disposed between the pixel electrodes and the common electrode. The method includes the steps of generating a plurality of positive gradation voltages with a first voltage dividing resistor circuit, the first voltage dividing resistor circuit being a single series circuit formed by a plurality of resistors connected in series, each of the positive gradation voltages being higher than a midpoint voltage Vasc, generating a plurality of negative gradation voltages with a second voltage dividing resistor circuit, the second voltage dividing resistor circuit being a single series circuit formed by a plurality of resistors connected in series, each of the negative gradation voltages being lower than the midpoint voltage Vasc and being paired with a respective one of the positive gradation voltages, thereby providing a plurality of paired positive and negative gradation voltages, and applying the positive gradation voltages and the negative gradation voltages to the pixel electrodes in accordance with a display signal representing information to be displayed on the TFT liquid crystal display panel. Respective averages of the paired positive and negative gradation voltages are positive, and increase with respect to a reference voltage VC as respective differences between the paired positive and negative gradation voltages decrease, the reference voltage VC being lower than the midpoint voltage Vasc.

24 Claims, 4 Drawing Sheets

METHOD OF DRIVING AN ACTIVE MATRIX LIQUID CRYSTAL DISPLAY PANEL WITH ASYMMETRIC SIGNALS

This is a continuation of application Ser. No. 08/432,864 filed on May 2, 1995, now abandoned, which is a continuation of application Ser. No. 08/281,575 filed on Jul. 28, 1994, now abandoned.

BACKGROUND OF THE INVENTION

1. Field of the Invention

The present invention relates to a liquid crystal display driving method and a liquid crystal display device, and more specifically to a technique suitably applied to a thin-film transistor liquid crystal display panel that performs multiple-gradation display.

2. Prior Art

An active matrix color liquid crystal display device using thin-film transistors (TFTs) has been described in publications, such as Nikkei Electronics, Nikkei McGraw-Hill, Sept. 10, 1984, pp. 211–240. TFT liquid crystal displays are used as a small, low power consumption display, primarily for the monitors in microcomputer systems. For office automation equipment, there are growing demands for display devices that can display an image of multiple gradations and multiple colors. There are multiple-color drivers that use CMOS switches for outputting gradation level (or brightness level) voltages. An example of such a driver is the HD66310T driver described in *Hitachi LCD Driver Data Book*, Hitachi, Ltd., Mar. 1990, pp. 650–664 (Japanese edition) and pp. 910–929 (English edition).

The driving voltages for a conventional liquid crystal display device with multiple gradations, as shown in FIG. 4, are such that gradation voltages Vsigl-Vsign are converted into alternating voltages with a reference voltage VC as their average. The reference voltage VC is also used as a white signal in the case of normally white. In pixel electrodes that act equivalently as capacitors, an interference voltage is generated at the gate electrode of the TFT transistor. This interference voltage may cause an afterimage phenomenon. To prevent this, a voltage Vcom applied to a common electrode of the TFT liquid crystal display panel is shifted from the reference voltage VC to produce a DC voltage VDC that cancels the interference voltage.

SUMMARY OF THE INVENTION

In the above method of canceling the interference voltage, it is assumed that the amounts of interference for all gradation voltages are equal. However, an investigation of this conducted by the inventors of the present application has revealed that as the gradation voltage increases, the amount of interference decreases approaching the average of the gradation voltages A, as shown in FIG. 3. That is, the optimum common voltage Vcom produced in consideration of the interference voltage changes with an increase in the gradation voltage Vsig, as shown by a curve B. However, because the display panel is provided with only one common electrode and the gradation voltages supplied to pixels are separate from each other in terms of time and space, it is impossible to minutely adjust the common electrode voltage according to the gradation voltages of individual pixels.

An object of this invention is to provide a liquid crystal display driving method and a liquid crystal display device that provides a multiple gradation image and prevents an afterimage phenomenon.

These and other objects and novel features of this invention will become apparent from the description of this specification and the attached drawings.

Means to Solve the Problem

Representative inventions disclosed in this specification may be briefly summarized as follows. A plurality of positive and negative gradation voltages for driving a TFT liquid crystal display panel are generated by a voltage dividing resistor circuit in such a way that the average value of the positive gradation voltages and the negative gradation voltages increases with respect to the common voltage as the signal amplitude decreases.

Operation

With the above-mentioned means, the positive and negative values of each gradation voltage can be made asymmetrical and their average value can be optimized with respect to the common electrode voltage, such that it is possible to prevent the afterimage phenomenon while achieving a multiple gradation display.

DESCRIPTION OF THE PREFERRED EMBODIMENTS

Figure 1:
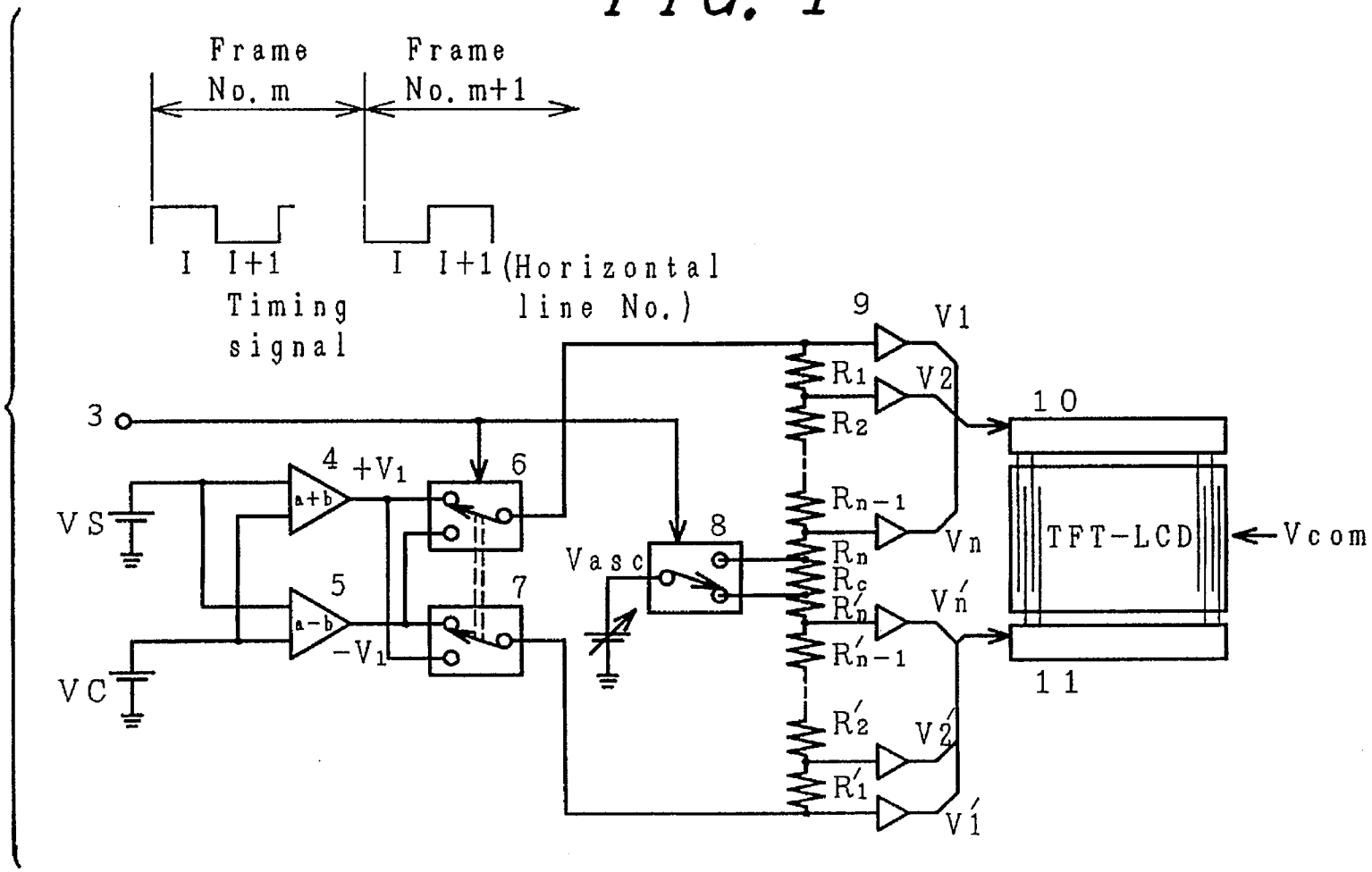
FIG. 1 is a schematic diagram showing an embodiment of a liquid crystal display device of this invention.

FIG. 1 is a schematic diagram of the liquid crystal display device of a embodiment of this invention.

In the FIG. 1, numeral 3 denotes a timing signal (alternating signal), 4 an addition circuit, 5 a subtraction circuit, 6–8 switches, 9 buffer, 10, 11 drain drivers, and TFT-LCD a liquid crystal display panel.

In this embodiment, only the circuit that generates gradation voltages is shown in the diagram, and the gate driver (scanning line drive circuit) for the liquid crystal display panel TFT-LCD, a display signal input circuit and a timing control circuit are omitted.

The addition circuit 4 adds the reference voltage VC and the signal voltage VS to form a positive maximum voltage +V1 (VC+VS). The subtraction circuit 5 subtracts the signal voltage VS from the reference voltage VC to form a negative maximum voltage −V1 (VC−VS). These voltages are supplied through the switches 6, 7 to opposite ends of a voltage dividing resistor circuit that produces gradation voltages. The voltage dividing resistor circuit is divided into an upper voltage dividing resistor circuit and a lower voltage dividing resistor circuit. The switches 6 and 7 are controlled by the timing signal 3. When the switch 6 is outputting the positive maximum voltage +V1 (VC+VS), the switch 7 outputs the negative maximum voltage −V1 (VC−VS). When the timing signal 3 is inverted, the switch 6 outputs the negative maximum voltage −V1 and the switch 7 outputs the positive maximum voltage +V1.

The voltage dividing resistor circuit consists of resistors connected in series and outputs a positive maximum value V1 (+V1) and a negative maximum value V1' (−V1) from its ends. At the interconnection points of the resistors are produced gradation voltages V2, . . . , Vn of positive polarity and gradation voltages Vn', . . . , V2' of negative polarity. In this embodiment, as shown in the waveform diagram of FIG. 2, the paired positive and negative voltages are made asymmetrical with respect to the center value VC of the positive maximum voltage +V1 and the negative maximum voltage −V1 in such a way that, as the signal amplitude of the paired positive and negative gradation voltages V2 and V2', . . . , Vn and Vn' decrease, the average value of each pair increases with respect to the common voltage Vcom.

In FIG. 1, the gradation voltages generated by the voltage dividing resistor circuit are output as positive gradation voltages V1−Vn from the upper voltage dividing resistor circuit through the buffer 9 which may be a voltage follower circuit, for example and as negative gradation voltages Vn'−V1' from the lower half of the voltage dividing resistor circuit. The figure shows the polarities of the gradation voltages according to the connection of the switches 6, 7. In accordance with the switching of the switches 6, 7, the negative voltages Vn'−V1' are output from the upper voltage dividing resistor circuit, and the positive voltages V1−Vn are output from the lower voltage dividing resistor circuit.

The gradation voltages generated by the upper voltage dividing resistor circuit are supplied to the upper drain driver 10 of the liquid crystal display panel TFT-LCD, and the gradation voltages produced by the lower voltage dividing resistor circuit are supplied to the lower drain driver 11 of the liquid crystal display panel TFT-LCD. The drain lines (signal lines) of the liquid crystal display panel TFT-LCD are divided into an odd-numbered line group and an even-numbered line group, with the odd-numbered drain lines being driven by the upper drain driver 10 and the even-numbered drain lines being driven by the lower drain driver 11. These two drain drivers 10, 11 feed driving signals of opposite polarities to adjacent drain lines.

In such a configuration wherein the polarities of the gradation voltages are switched by the alternating signal on the gradation voltage generation circuit side, it is possible to reduce the number of switches of the drain driver because the same switch can be used to output both the positive and negative driving voltages corresponding to the display signal.

Figure 2:
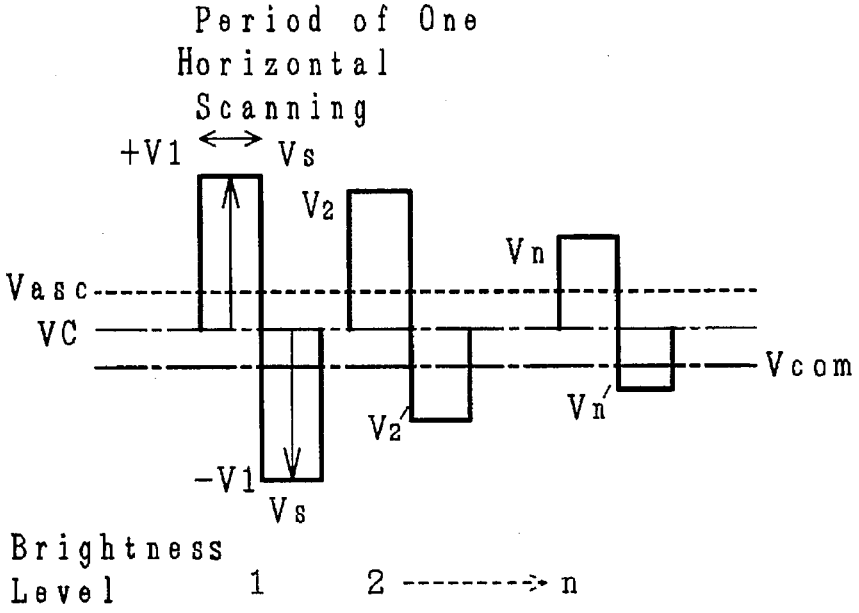
FIG. 2 is a waveform diagram showing voltages used in a liquid crystal display driving method and a liquid crystal display device of this invention.
Figure 3:
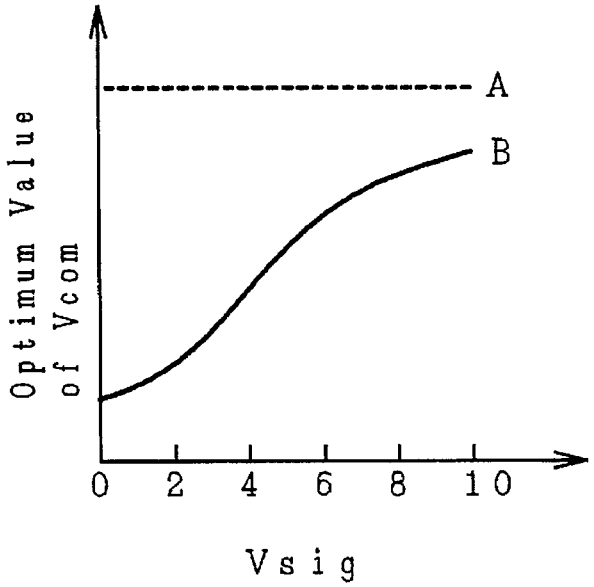
FIG. 3 is a characteristic diagram showing the relation between the gradation voltage and the optimum common voltage.
Figure 4:
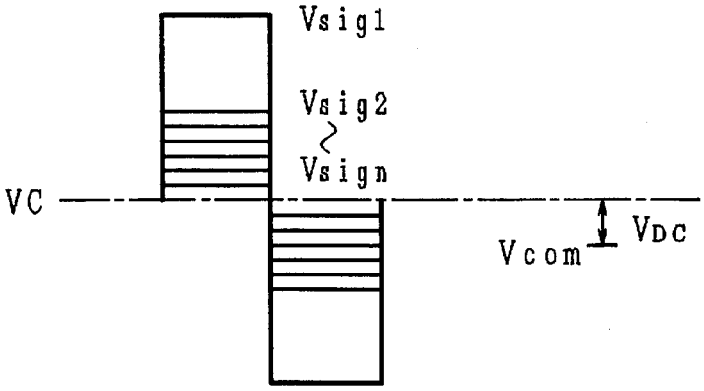
FIG. 4 is a waveform diagram showing an example of conventional multiple-gradation driving signals.

To the midpoint of the voltage dividing circuit is supplied a midpoint voltage Vasc that is adjustable. This midpoint voltage Vasc is used as a correction voltage. By adjusting this voltage it is possible to shift either to the positive or negative side all the gradation voltages V1−V1' generated by the voltage dividing resistor circuit. In the configuration of this embodiment in which the voltage polarity is switched on the gradation voltage generation circuit side, the midpoint voltage Vasc is switched by the switch 8 and supplied to the voltage dividing resistor circuit so that it corresponds to the asymmetrical driving voltages as shown in FIG. 2. Like the switches 6, 7, this switch 8 is also changed over in synchronism with the timing signal 3. This switch may be omitted and the midpoint voltage Vasc may be supplied to a fixed point in the voltage dividing resistor circuit.

Figure 5:
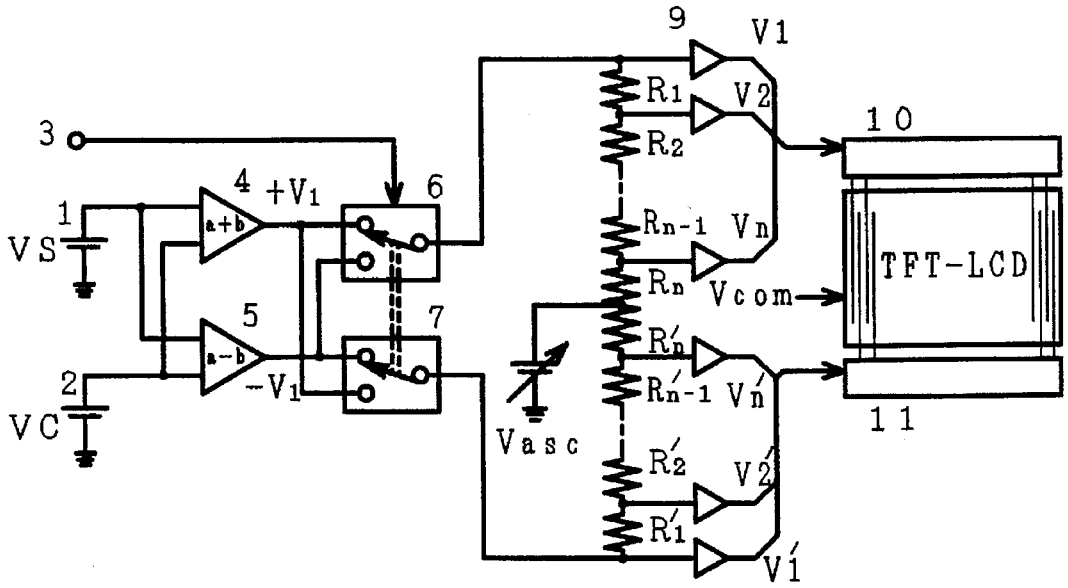
FIG. 5 is a schematic diagram showing a liquid crystal display device of another embodiment of this invention.

FIG. 5 shows another embodiment of this invention. The point in which this embodiment differs from the first embodiment of FIG. 1 is that the switch 8 is omitted and the midpoint voltage Vasc is supplied to a fixed point in the voltage dividing resistor circuit.

Figure 6A:
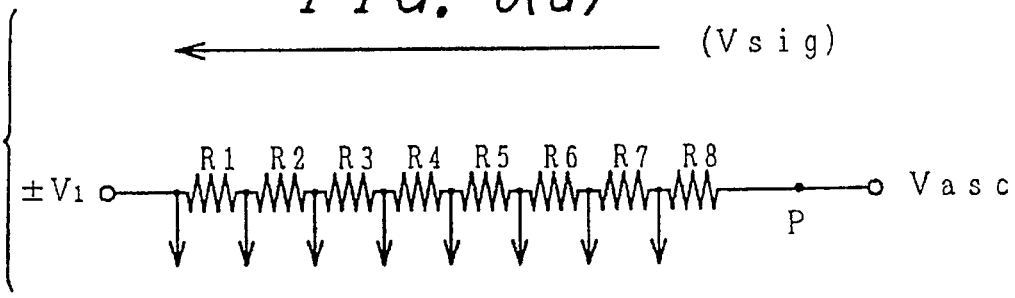
FIGS. 6(*a*) and 6(*b*) are diagrams showing the relation between voltages at various points in the second embodiment of the liquid crystal display driving method according to this invention.
Figure 6B:
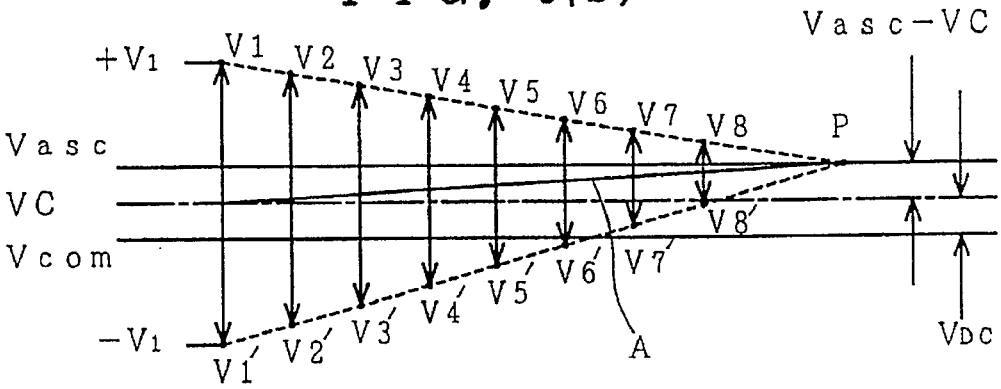

FIGS. 6(*a*) and 6(*b*) are diagrams for explaining voltage relationships of another embodiment.

For simplicity of explanation, let us consider a case where Rn=Rn' and n=8 in FIG. 5. This is shown in FIG. 6(*a*).

FIG. 6(*b*) shows the voltage relation between V1−V1', Vasc, VC and Vcom shown as ordinates, with the abscissas made to correspond to that of FIG. 6(*a*).

FIGS. 6(*a*) and 6(*b*) represent the state at the moment in which the switches 6, 7 are in the state of FIG. 5. When the switches 6, 7 are changed over, the relationship between V1−Vn and V1'−Vn' is reversed.

In FIG. 6(*a*), the potential at the end P of R8 is set to Vasc and the potentials of V1 and V1' are set to +V1 and −V1, respectively, so that the gradation voltages V1−Vn, V1'−Vn' lie on a straight line connecting +V1 and P and a straight line connecting −V1 and P, respectively.

Therefore, if Vasc is shifted from VC, the average value A of paired voltages V1 and V1' to paired voltages Vn and Vn' changes from VC to nearly Vasc as n increases.

Figure 7:
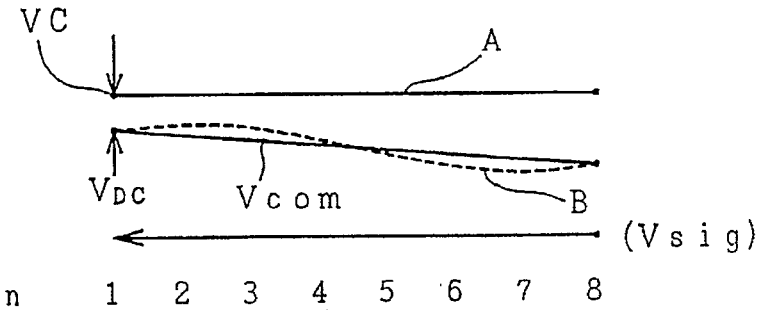
FIG. 7 is a diagram showing the relation between the gradation voltage and the optimum common voltage in the liquid crystal display driving method of this invention.

Because VC is set to be deviated from Vcom by VDC, the Vcom, when seen from the average value A, becomes shifted by more than VDC as n increases, as shown in FIG. 7.

Therefore, by setting Vasc to an optimum value, it is possible to set Vcom to a value approximating an optimum value shown by a curve B, as shown in FIG. 7.

The above embodiment has a drawback that when the polarity is switched for each frame (a period of display of one screen) to produce alternating voltages, the polarity inversion is done at a relatively low frequency, causing flickers of the screen. To eliminate this drawback, the polarity is switched every two or more scanning lines in one frame to increase the frequency at which alternating voltages are produced to several hundred Hz to prevent flicker. Therefore, in this embodiment also, the polarity of one frame m is made to differ from that of the next frame m+1. Although the timing signal of one cycle is representatively shown in the figure, the timing signal is actually changed in two or more cycles in one frame to increase the frequency at which alternating voltages are produced to several hundred Hz.

The advantages of the above embodiment are as follows.

(1) A plurality of paired positive and negative gradation voltages to be applied to a TFT liquid crystal display panel are produced by a voltage dividing resistor circuit in such a way that the average value of the paired positive and negative gradation voltages increases with respect to the common voltage as the signal amplitude becomes small. Because this method allows the average of the paired gradation voltages to be set at an optimum value for the common electrode voltage, it is possible to prevent the afterimage phenomenon while achieving multiple gradation display.

(2) To the opposite ends of the voltage dividing resistor circuit that produces a plurality of paired gradation voltages are applied the sum and the difference of the signal voltage and the reference voltage in accordance with the alternating signal. To two midpoints of the voltage dividing resistor circuit is supplied an adjustable midpoint voltage in accordance with alternating polarities. Because asymmetrical paired gradation voltages of opposite polarities can be produced at the same output terminal, the drain driver can be simplified.

The embodiments of this invention have been described in detail and it should be noted that this invention is not limited to these embodiments and that various modifications may be made without departing from the gist of this invention. For example, when the gradation voltages +V1 to +Vn and −V1 to −Vn are generated fixedly, the addition circuit and subtraction circuit can be omitted, so that the gradation voltage generation circuit can be simplified although the number of switches increases on the drain driver side. Therefore, this is advantageous when the number of gradation levels is small. In this case, the midpoint voltage Vasc may be omitted and the common voltage Vcom may be made adjustable. Further, when a color display is to be performed, a set of three primary color filters must be provided for each set of three pixels on the TFT liquid crystal display panel.

This intention can be widely applicable to a liquid crystal display driving method and a liquid crystal display device that performs a gradation display using a TFT liquid crystal display panel.

What is claimed is:

1. A method for driving a liquid crystal display device, the liquid crystal display device including a TFT liquid crystal display panel, the TFT liquid crystal display panel including a drain line, a pixel electrode connected to the drain line, a common electrode opposing the pixel electrode, and a liquid crystal layer disposed between the pixel electrode and the common electrode, the method comprising the steps of:

generating a plurality of positive gradation voltages with a first voltage dividing resistor circuit, the first voltage dividing resistor circuit being a single series circuit formed by a plurality of resistors connected in series, each of the positive gradation voltages being higher than a midpoint voltage Vasc;

generating a plurality of negative gradation voltages with a second voltage dividing resistor circuit, the second voltage dividing resistor circuit being a single series circuit formed by a plurality of resistors connected in series, each of the negative gradation voltages being lower than the midpoint voltage Vasc and being paired with a respective one of the positive gradation voltages, thereby providing a plurality of paired positive and negative gradation voltages; and applying the positive gradation voltages and the negative gradation voltages to the drain line in accordance with a display signal representing information to be displayed on the TFT liquid crystal display panel;

wherein respective averages of the paired positive and negative gradation voltages increase with respect to a reference voltage VC as respective differences between the paired positive and negative gradation voltages decrease, the reference voltage VC being lower than the midpoint voltage Vasc.

2. A method according to claim 1, further comprising the step of applying a common voltage Vcom to the common electrode;

wherein the common voltage Vcom is lower than the reference voltage VC by a fixed amount VDC.

3. A liquid crystal display device comprising:

a TFT liquid crystal display panel including a drain line, a pixel electrode connected to the drain line, a common electrode opposing the pixel electrode, and a liquid crystal layer disposed between the pixel electrode and the common electrode;

a first voltage dividing resistor circuit for generating a plurality of positive gradation voltages, the first voltage dividing resistor circuit being a single series circuit formed by a plurality of resistors connected in series, each of the positive gradation voltages being higher than a midpoint voltage Vasc;

a second voltage dividing resistor circuit for generating a plurality of negative gradation voltages, the second voltage dividing resistor circuit being a single series circuit formed by a plurality of resistors connected in series, each of the negative gradation voltages being lower than the midpoint voltage Vasc and being paired with a respective one of the positive gradation voltages, thereby providing a plurality of paired positive and negative gradation voltages; and means for applying the positive gradation voltages and the negative gradation voltages to the drain line in accordance with a display signal representing information to be displayed on the TFT liquid crystal display panel;

wherein respective averages of the paired positive and negative gradation voltages increase with respect to a reference voltage VC as respective differences between the paired positive and negative gradation voltages decrease, the reference voltage VC being lower than the midpoint voltage Vasc.

4. A liquid crystal display device according to claim 3, further comprising means for applying a common voltage Vcom to the common electrode;

wherein the common voltage Vcom is lower than the reference voltage VC by a fixed amount VDC.

5. A liquid crystal display device according to claim 3, wherein a first end of the first voltage dividing resistor circuit is connected to a first end of the second voltage dividing resistor circuit; and wherein the liquid crystal display device further comprises:

means for generating a signal voltage VS;

means for generating the reference voltage VC;

means for generating the midpoint voltage Vasc, the midpoint voltage Vasc being an adjustable midpoint voltage Vasc;

an addition circuit for producing a sum voltage VC+VS;

a subtraction circuit for producing a difference voltage VC−VS;

means for supplying the sum voltage VC+VS to a second end of the first voltage dividing resistor circuit and the difference voltage VC−VS to a second end of the second voltage dividing resistor circuit during first periods, and supplying the difference voltage VC−VS to the second end of the first voltage dividing resistor circuit and the sum voltage VC+VS to the second end of the second voltage dividing resistor circuit during second periods alternating with the first periods; and means for supplying the adjustable midpoint voltage Vasc to a point between the first end and the second end of the second voltage dividing circuit during the first periods, and supplying the adjustable midpoint voltage Vasc to a point between the first end and the second end of the first voltage dividing circuit during the second periods.

6. A liquid crystal display device according to claim 3, further comprising:

means for generating a fixed positive voltage and supplying the fixed positive voltage to one end of the first voltage dividing resistor circuit; and means for generating a fixed negative voltage and supplying the fixed negative voltage to one end of the second voltage dividing resistor circuit;

wherein the fixed positive voltage is output from the one end of the first voltage dividing resistor circuit as a maximum positive gradation voltage of the positive gradation voltages; and wherein the fixed negative voltage is output from the one end of the second voltage dividing resistor circuit as a maximum negative gradation voltage of the negative gradation voltages.

7. A method for driving a liquid crystal display device, the liquid crystal display device including a TFT liquid crystal display panel, the TFT liquid crystal display panel including a drain line, a pixel electrode connected to the drain line, a common electrode opposing the pixel electrode, and a liquid crystal layer disposed between the pixel electrode and the common electrode, the method comprising the steps of:

generating a plurality of positive gradation voltages with a first voltage dividing resistor circuit, the first voltage dividing resistor circuit being a single series circuit formed by a plurality of resistors connected in series, each of the positive gradation voltages being higher than a midpoint voltage Vasc;

generating a plurality of negative gradation voltages with a second voltage dividing resistor circuit, the second voltage dividing resistor circuit being a single series circuit formed by a plurality of resistors connected in series, each of the negative gradation voltages being lower than the midpoint voltage Vasc and being paired with a respective one of the positive gradation voltages, thereby providing a plurality of paired positive and negative gradation voltages; and applying the positive gradation voltages and the negative gradation voltages to the drain line in accordance with a display signal representing information to be displayed on the TFT liquid crystal display panel;

wherein respective averages of the paired positive and negative gradation voltages are positive and increase as respective differences between the paired positive and negative gradation voltages decrease.

8. A method according to claim 7, further comprising the step of applying a common voltage Vcom to the common electrode;

wherein the common voltage Vcom is lower than the reference voltage VC by a fixed amount VDC.

9. A liquid crystal display device comprising:

a TFT liquid crystal display panel including a drain line, a pixel electrode connected to the drain line, a common electrode opposing the pixel electrode, and a liquid crystal layer disposed between the pixel electrode and the common electrode;

a first voltage dividing resistor circuit for generating a plurality of positive gradation voltages, the first voltage dividing resistor circuit being a single series circuit formed by a plurality of resistors connected in series, each of the positive gradation voltages being higher than a midpoint voltage Vasc;

a second voltage dividing resistor circuit for generating a plurality of negative gradation voltages, the second voltage dividing resistor circuit being a single series circuit formed by a plurality of resistors connected in series, each of the negative gradation voltages being lower than the midpoint voltage Vasc and being paired with a respective one of the positive gradation voltages, thereby providing a plurality of paired positive and negative gradation voltages; and means for applying the positive gradation voltages and the negative gradation voltages to the drain line in accordance with a display signal representing information to be displayed on the TFT liquid crystal display panel;

wherein respective averages of the paired positive and negative gradation voltages are positive and increase as respective differences between the paired positive and negative gradation voltages decrease.

10. A liquid crystal display device according to claim 9, further comprising means for applying a common voltage Vcom to the common electrode;

wherein the common voltage Vcom is lower than the reference voltage VC by a fixed amount VDC.

11. A liquid crystal display device according to claim 9, further comprising polarity inverting means connected to the first voltage dividing resistor circuit and the second voltage dividing resistor circuit for inverting polarities of the positive gradation voltages and the negative gradation voltages at predetermined intervals.

12. A liquid crystal display device according to claim 9, further comprising:

means for generating a fixed positive voltage and supplying the fixed positive voltage to one end of the first voltage dividing resistor circuit; and means for generating a fixed negative voltage and supplying the fixed negative voltage to one end of the second voltage dividing resistor circuit;

wherein the fixed positive voltage is output from the one end of the first voltage dividing resistor circuit as a maximum positive gradation voltage of the positive gradation voltages; and wherein the fixed negative voltage is output from the one end of the second voltage dividing resistor circuit as a maximum negative gradation voltage of the negative gradation voltages.

13. A method for driving a liquid crystal display device, the liquid crystal display device including a TFT liquid crystal display panel, the TFT liquid crystal display panel including a drain line, a pixel electrode connected to the drain line, a common electrode opposing the pixel electrode, and a liquid crystal layer disposed between the pixel electrode and the common electrode, the method comprising the steps of:

generating a plurality of positive gradation voltages with a first voltage dividing resistor circuit, the first voltage dividing resistor circuit being a single series circuit formed by a plurality of resistors connected in series, each of the positive gradation voltages being for establishing a respective voltage at a surface of the liquid crystal layer opposing the pixel electrode which is higher than a voltage at a surface of the liquid crystal layer opposing the common electrode;

generating a plurality of negative gradation voltages with a second voltage dividing resistor circuit, the second voltage dividing resistor circuit being a single series circuit formed by a plurality of resistors connected in series, each of the negative gradation voltages being for establishing a respective voltage at the surface of the liquid crystal layer opposing the pixel electrode which is lower than a voltage at the surface of the liquid crystal layer opposing the common electrode and being paired with a respective one of the positive gradation voltages, thereby providing a plurality of paired positive and negative gradation voltages; and applying the positive gradation voltages and the negative gradation voltages to the drain line in accordance with a display signal representing information to be displayed on the TFT liquid crystal display panel;

wherein respective average voltages of the paired positive and negative gradation voltages increase with respect to the average voltage of a pair of the paired positive and negative gradation voltages having a maximum voltage difference therebetween as respective voltage differences between the paired positive and negative gradation voltages decrease.

14. A method according to claim 13, further comprising the step of applying a common voltage Vcom to the common electrode;

wherein the TFT liquid crystal display panel has a characteristic which causes an optimum value of the common voltage Vcom to decrease as respective voltage differences between paired symmetric positive and negative gradation voltages decrease, the respective voltage differences between the paired symmetric positive and negative gradation voltages being respectively equal to the respective voltage differences between the paired positive and negative gradation voltages, respective average voltages of the paired symmetric positive and negative gradation voltages being equal to the average voltage of the pair of the paired positive and negative gradation voltages having the maximum voltage difference therebetween; and wherein the increase in the respective average voltages of the paired positive and negative gradation voltages is equal to the decrease in the optimum common voltage Vcom.

15. A method according to claim 13, further comprising the step of applying a common voltage Vcom to the common electrode;

wherein a value of the common voltage Vcom is an optimum value for the pair of the paired positive and negative gradation voltages having the maximum voltage difference therebetween.

16. A liquid crystal display device comprising:

a TFT liquid crystal display panel including a drain line, a pixel electrode connected to the drain line, a common electrode opposing the pixel electrode, and a liquid crystal layer disposed between the pixel electrode and the common electrode;

a first voltage dividing resistor circuit for generating a plurality of positive gradation voltages, the first voltage dividing resistor circuit being a single series circuit formed by a plurality of resistors connected in series, each of the positive gradation voltages being for establishing a respective voltage at a surface of the liquid crystal layer opposing the pixel electrode which is higher than a voltage at a surface of the liquid crystal layer opposing the common electrode;

a second voltage dividing resistor circuit for generating a plurality of negative gradation voltages, the second voltage dividing resistor circuit being a single series circuit formed by a plurality of resistors connected in series, each of the negative gradation voltages being for establishing a respective voltage at the surface of the liquid crystal layer opposing the pixel electrode which is lower than a voltage at the surface of the liquid crystal layer opposing the common electrode and being paired with a respective one of the positive gradation voltages, thereby providing a plurality of paired positive and negative gradation voltages; and means for applying the positive gradation voltages and the negative gradation voltages to the drain line in accordance with a display signal representing information to be displayed on the TFT liquid crystal display panel;

wherein respective average voltages of the paired positive and negative gradation voltages increase with respect to the average voltage of a pair of the paired positive and negative gradation voltages having a maximum voltage difference therebetween as respective voltage differences between the paired positive and negative gradation voltages decrease.

17. A liquid crystal display device according to claim 16, further comprising means for applying a common voltage Vcom to the common electrode;

wherein the TFT liquid crystal display panel has a characteristic which causes an optimum value of the common voltage Vcom to decrease as respective voltage differences between paired symmetric positive and negative gradation voltages decrease, the respective voltage differences between the paired symmetric positive and negative gradation voltages being respectively equal to the respective voltage differences between the paired positive and negative gradation voltages, respective average voltages of the paired symmetric positive and negative gradation voltages being equal to the average voltage of the pair of the paired positive and negative gradation voltages having the maximum voltage difference therebetween; and wherein the increase in the respective average voltages of the paired positive and negative gradation voltages is equal to the decrease in the optimum common voltage Vcom.

18. A liquid crystal display device according to claim 16, further comprising means for applying a common voltage Vcom to the common electrode;

wherein a value of the common voltage Vcom is an optimum value for the pair of the paired positive and negative gradation voltages having the maximum voltage difference therebetween.

19. A liquid crystal display device according to claim 16, wherein a first end of the first voltage dividing resistor circuit is connected to a first end of the second voltage dividing resistor circuit at a junction point; and wherein the liquid crystal display device further comprises:

means for generating a signal voltage VS;

means for generating a reference voltage VC;

means for generating an adjustable midpoint voltage Vasc;

an addition circuit for producing a sum voltage VC+VS;

a subtraction circuit for producing a difference voltage VC−VS;

means for supplying the sum voltage VC+VS to a second end of the first voltage dividing resistor circuit and the difference voltage VC−VS to a second end of the second voltage dividing resistor circuit during first periods, and supplying the difference voltage VC−VS to the second end of the first voltage dividing resistor circuit and the sum voltage VC+VS to the second end of the second voltage dividing resistor circuit during second periods alternating with the first periods; and means for supplying the adjustable midpoint voltage Vasc to the junction point where the first end of the first voltage dividing resistor circuit is connected to the first end of the second voltage dividing resistor circuit.

20. A liquid crystal display device according to claim 19, wherein the TFT liquid crystal display panel further includes a scanning line;

wherein the pixel electrode is associated with the scanning line;

wherein the display signal includes a scanning line period corresponding to the scanning line; and wherein the liquid crystal display device further comprises polarity inverting means connected to the first voltage dividing resistor circuit and the second voltage dividing resistor circuit for inverting polarities of the positive gradation voltages and the negative gradation voltages at predetermined intervals each corresponding to at least two of the scanning line period of the display signal.

21. A liquid crystal display device according to claim 16, wherein a first end of the first voltage dividing resistor circuit is connected to a first end of the second voltage dividing resistor circuit; and wherein the liquid crystal display device further comprises:

means for generating a first fixed voltage;

means for generating a second fixed voltage;

means for generating an adjustable midpoint voltage Vasc;

means for supplying the first fixed voltage to a second end of the first voltage dividing resistor circuit and the second fixed voltage to a second end of the second voltage dividing resistor circuit during first periods, and supplying the second fixed voltage to the second end of the first voltage dividing resistor circuit and the first fixed voltage to the second end of the second voltage dividing resistor circuit during second periods alternating with the first periods; and means for supplying the adjustable midpoint voltage Vasc to a point between the first end and the second end of the second voltage dividing circuit during the first periods, and supplying the adjustable midpoint voltage Vasc to a point between the first end and the second end of the first voltage dividing circuit during the second periods.

22. A liquid crystal display device according to claim 21, wherein the TFT liquid crystal display panel further includes a scanning line;

wherein the pixel electrode is associated with the scanning line;

wherein the display signal includes a scanning line period corresponding to the scanning line; and wherein the liquid crystal display device further comprises polarity inverting means connected to the first voltage dividing resistor circuit and the second voltage dividing resistor circuit for inverting polarities of the positive gradation voltages and the negative gradation voltages at predetermined intervals each corresponding to at least two of the scanning line period of the display signal.

23. A liquid display device according to claim 16, wherein a first end of the first voltage dividing resistor circuit is connected to a first end of the second voltage dividing a resistor circuit at a junction point; and wherein the liquid crystal display device further comprises:

means for generating a first fixed voltage;

means for generating a second fixed voltage;

means for generating an adjustable midpoint voltage Vasc;

means for supplying the first fixed voltage to a second end of the first voltage dividing resistor circuit and the second fixed voltage to a second end of the second voltage dividing resistor circuit during first periods, and supplying the second fixed voltage to the second end of the first voltage dividing resistor circuit and the first fixed voltage to the second end of the second voltage dividing resistor circuit during second periods alternating with the first periods; and means for supplying the adjustable midpoint voltage Vasc to the junction point where the first end of the first voltage dividing resistor circuit is connected to the first end of the second voltage dividing resistor circuit.

24. A liquid crystal display device according to claim 23, wherein the TFT liquid crystal display panel further includes a scanning line;

wherein the pixel electrode is associated with the scanning line;

wherein the display signal includes a scanning line period corresponding to the scanning line; and wherein the liquid crystal display device further comprises polarity inverting means connected to the first voltage dividing resistor circuit and the second voltage dividing resistor circuit for inverting polarities of the positive gradation voltages and the negative gradation voltages at predetermined intervals each corresponding to at least two of the scanning line of period of the display signal.

* * * * *